United States Patent [19]

Scott

[11] Patent Number: 4,972,536

[45] Date of Patent: Nov. 27, 1990

[54] LONGITUDINALLY LACED POSTURIZED AND/OR CONTOURED SPRING BEDDING PRODUCT

[75] Inventor: Terence A. Scott, Carthage, Mo.

[73] Assignee: Leggett & Platt, Incorporated, Carthage, Mo.

[21] Appl. No.: 411,059

[22] Filed: Sep. 22, 1989

Related U.S. Application Data

[63] Continuation-in-part of Ser. No. 285,778, Dec. 16, 1988, Pat. No. 4,918,773.

[51] Int. Cl.[5] ..... A47C 23/00

[52] U.S. Cl. ..... 5/464; 5/475; 5/268

[58] Field of Search ..... 5/247, 248, 255, 256, 5/268, 269, 464, 475, 476; 267/93, 95

[56] References Cited

U.S. PATENT DOCUMENTS

| | | | |
|---|---|---|---|
| 3,685,062 | 8/1972 | Pearson | 5/269 |
| 4,052,760 | 10/1977 | Golembeck et al. | 5/475 |
| 4,488,712 | 12/1984 | Higgins . | |
| 4,679,266 | 7/1987 | Kraft | 5/464 |

FOREIGN PATENT DOCUMENTS

| | | | |
|---|---|---|---|
| 228745 | 1/1959 | Australia | 5/475 |
| 1155218 | 10/1963 | Fed. Rep. of Germany | 5/475 |
| 839835 | 6/1960 | United Kingdom | 5/475 |
| 2143731 | 11/1986 | United Kingdom . | |
| 2198938 | 6/1988 | United Kingdom . | |

*Primary Examiner*—Michael F. Trettel

*Attorney, Agent, or Firm*—Wood, Herron & Evans

[57] ABSTRACT

A spring interior comprising a plurality of transversely extending bands of springs disposed side by side and connected together by longitudinally extending helical lacing wires in the top and bottom faces of the bands. Each band of springs comprises a single length of wire formed into a plurality of substantially vertical coil springs interconnected by interconnecting segments of wire located alternately in the top and bottom faces of the bands. The spring interior is characterized by sections of differing firmness or height throughout the length of the spring interior, which differing firmness or height sections are created by either having the wire from which the bands of coil springs differ in physical characteristics or by having the coil springs of the differing bands differ in height when in the relaxed state.

6 Claims, 3 Drawing Sheets

LONGITUDINALLY LACED POSTURIZED AND/OR CONTOURED SPRING BEDDING PRODUCT

This application is a Continuation-In-Part application of U.S. Patent Application Ser. No. 07/285,778 filed Dec. 16, 1988, now U.S. Pat. No. 4,918,773.

This invention relates to spring interiors and, specifically, to spring interiors for bedding products, such as mattresses and the like.

BACKGROUND OF THE INVENTION

A known form of spring interior comprises a plurality of longitudinally extending bands of springs disposed side by side and connected together by helical wires which extend transversely of the bands and embrace portions of the bands. Several kinds of bands of springs have been proposed for incorporation in spring interiors. One kind of band, which is the subject of British patent No. 2,143,731, will hereinafter be referred to as a band of interlocked or interlaced springs. It comprises a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a rotational hand opposite to the rotational hand of the adjacent coils immediately before and after it in the row, and being joined to the adjacent coil springs by a pair of interconnecting segments of wire integral with the coil springs. One of the pair of interconnecting segments is located in the bottom face of the band, and the other of the pair of interconnecting segments is located in the top face of the band. Each interconnecting segment comprises a bridging portion between adjacent coils, which bridging portion extends lengthwise of the row.

When bands of interlocked springs of the type described hereinabove are assembled to form a spring interior, they are disposed side by side and interconnected by helical wires, some of which lie in the top face of the spring interior and others of which lie in the bottom face thereof, the top and bottom faces of the spring interior being the faces defined by the top and bottom faces of the bands incorporated in the spring interior. Each helical wire extends across the bands of springs and embraces portions of wires of the bands that extend transversely of the bands from the ends of the bridging portions of the links. In the top face of the spring interior the helical wires are disposed at uniform intervals along the bands of springs, the arrangement being such that there are two springs disposed in the interval between each helical wire and the next. There is a similar arrangement in the bottom face of the spring interior.

In this description of the invention there are references to faces of bands of springs and of spring interiors. As the bands of springs and spring interiors are, of course, of open-work or skeletal form, the term "face" must be understood as referring to an imaginary surface defined by the relevant parts of the bands or spring interiors. Furthermore, as the wires and helical wires are of finite width or thickness and as they sometimes overlap each other, the term "face" cannot be understood as having a strictly geometrical meaning. Nevertheless, as the faces concerned are relatively extensive and are of flat shape, their locations can in practice be determined without difficulty or ambiguity.

It is customary for a bedding spring interior or a seat spring interior to be incorporated in an upholstered article. In such an article at least one of the main faces of the spring interior (that is the top and bottom faces thereof) is covered by a layer or layers of padding. This is turn is covered by a cover made of sheet material, such as ticking or upholstery fabric.

Pressure is applied unevenly to the top surface of a mattress or chair seat when a person reclines atop a mattress or sits atop a seating surface. This uneven pressure or uneven loading of the surface is a consequence of the uneven weight distribution of a person on the surface. In the case of a mattress, the heaviest portion of the body is located approximately midway along the length of the body, and consequently, a person reclining atop a mattress tends to cause the mattress to deflect or sag to a greater extent in the lengthwise center of the mattress than at the ends. This uneven deflection in turn results in a person reclining atop the mattress having an unnatural and uncomfortable misalignment imparted to his or her spine.

To counter this uneven deflection of a mattress when a person is reclining atop the mattress, it has been proposed to reinforce or rigidify the lengthwise center section of the mattress. Such center section reinforcement or rigidification has taken the form of increasing the number or density of springs in the center section of the mattress, using different or firmer springs in the center section of the mattress, or adding additional structure to the center section to reinforce that section to a greater extent than the end sections. One patent which discloses differing zones of firmness in a spring mattress is U.S. Pat. No. 4,679,266. In this patent, the zones of differing firmness are created by the installation of coil springs of differing firmness in each of the differing firmness zones. But, the mattress disclosed in this U.S. patent, as well as all spring mattresses which are characterized by zones of differing firmness, has in the past been relatively expensive to manufacture, primarily because of the difficulty of automating the manufacture and, particularly, the assembly of such mattresses or spring assemblies.

It has therefore been an objective of this invention to provide an improved method and apparatus for imparting differing firmness to differing lengthwise sections of a spring mattress or spring seating assembly.

Still another objective of this invention has been to provide an improved method and apparatus for increasing the firmness of selected lengthwise sections of a bedding or seating spring interior of the interlocked spring type described hereinabove.

SUMMARY OF THE INVENTION

The invention of this application which achieves these objectives comprises a spring interior having a plurality of transversely extending bands of interlocked or interlaced coil springs wherein the bands are disposed side by side so that their top faces lie in a top main face of the spring interior and their bottom faces lie in a bottom main face of the spring interior. The bands of springs are interconnected by longitudinally extending helical wires lying in the top and bottom faces of the bands and extending across the bands with each helical wire embracing portions of wires of the bands that extend transversely of the bands. In order to increase the firmness or the contour of a selected section of the spring interior, as for example, the lengthwise, center one-third of the spring interior, the transversely extending bands of interlocked springs in this selected section are formed by wire of heavier gauge (greater diameter) or greater height (when in the relaxed state) than the bands of the non-selected sections.

The primary advantage of the invention of this application is that it enables selected sections or portions of spring interiors made from multiple bands of interlocked or interlaced coils to be inexpensively and easily increased in firmness or contour by currently existing automated equipment without substantial changes being required to that equipment. Specifically, existing equipment need only be reoriented and slightly modified by well-known and easily accomplished modifications in order to enable that equipment to produce the novel spring interior of this invention.

Spring interiors made from multiple bands of interlocked or interlaced coil springs of the type described hereinabove are currently made by first forming the bands in the manner described in British Patent No. 937,644 and then coiling those interconnected bands into long, continuous lengths of interlaced coil springs interconnected by interconnecting segments. Those continuous lengths of coil springs each typically contain many times more individual bands than are required to form a single bedding spring interior. After the bands are formed into coils, they are conventionally moved to an assembly machine, such as the machine described in British Patent No. 1,095,980. This machine is operable to simultaneously feed bands longitudinally from several coils into the assembly machine where the individual bands are interconnected by transversely extending helical lacing wires.

Because the individual bands of springs in the spring interior are each uncoiled from a separate coil of bands of springs, each band of coil springs of a spring interior may be made of a differing gauge or diameter wire from the other bands of the said spring interior. Alternatively, each band of coil springs may be comprised of coils which, in the relaxed state, differ in height from the coils of the adjacent bands of coil springs. This characteristic is not of any particular advantage when applied to conventional prior art spring interiors made from multiple bands of longitudinally extending interlaced coils, but when applied t spring interiors of this invention wherein the bands extend transversely of the spring interior and are longitudinally laced, it is very advantageous. Specifically, when applied to spring interiors made from transversely extending bands of interlaced coil springs, it enables longitudinal sections of the spring interior to be "posturized" or made of differing height than other sections of the same spring interior upon currently available spring forming and assembly machines without substantial modification of those machines. In other words, this invention enables spring interiors made from bands of interlaced coils to be very inexpensively "posturized" or contoured, i.e., made of differing firmness and/or heights throughout the length of the spring interior.

These and other objects and advantages of this invention will become more readily apparent from the following description of the drawings in which.

Figure 1:
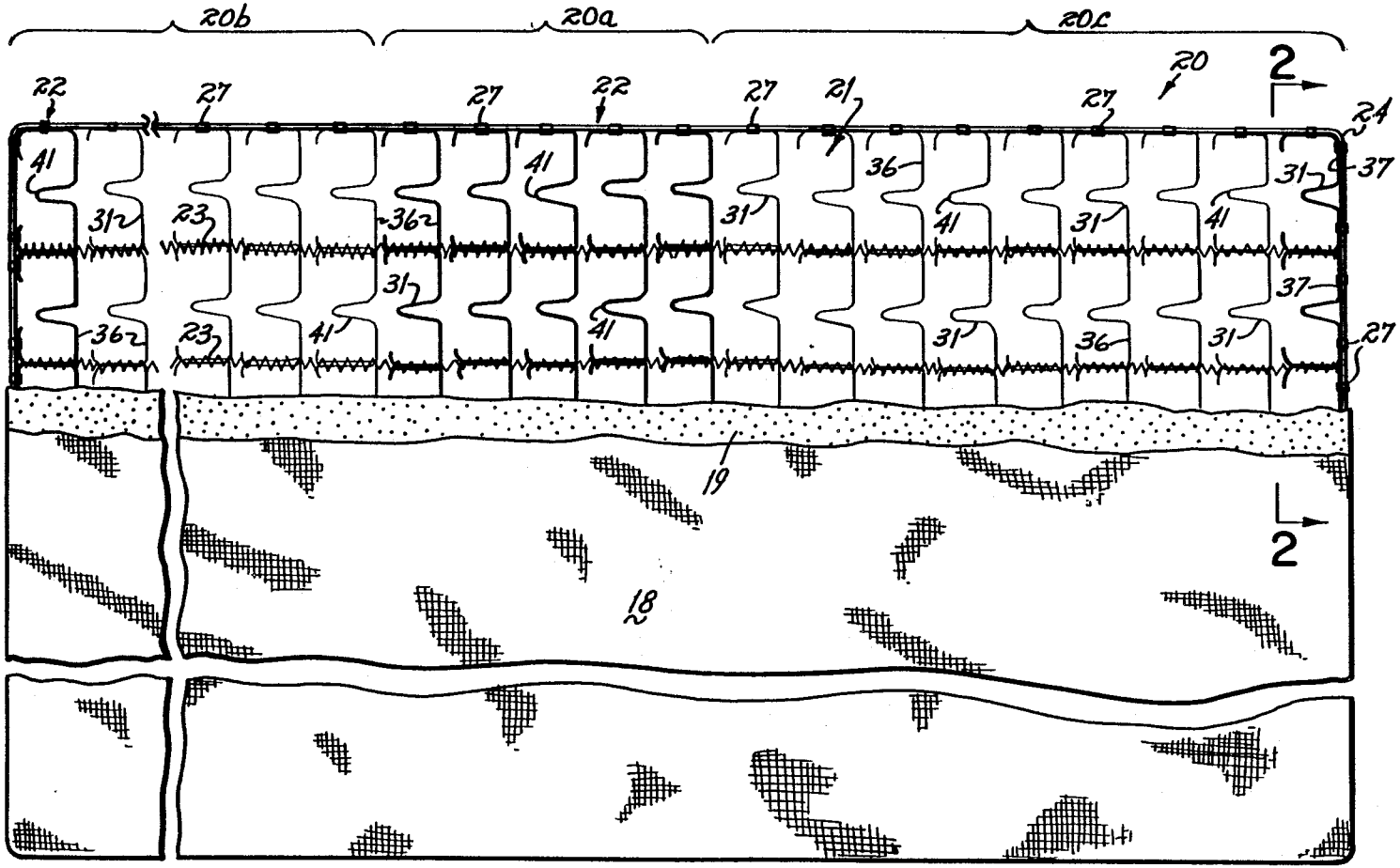
FIG. 1 is a top plan view, partially broken away, of a mattress incorporating the invention of this application.
Figure 2:
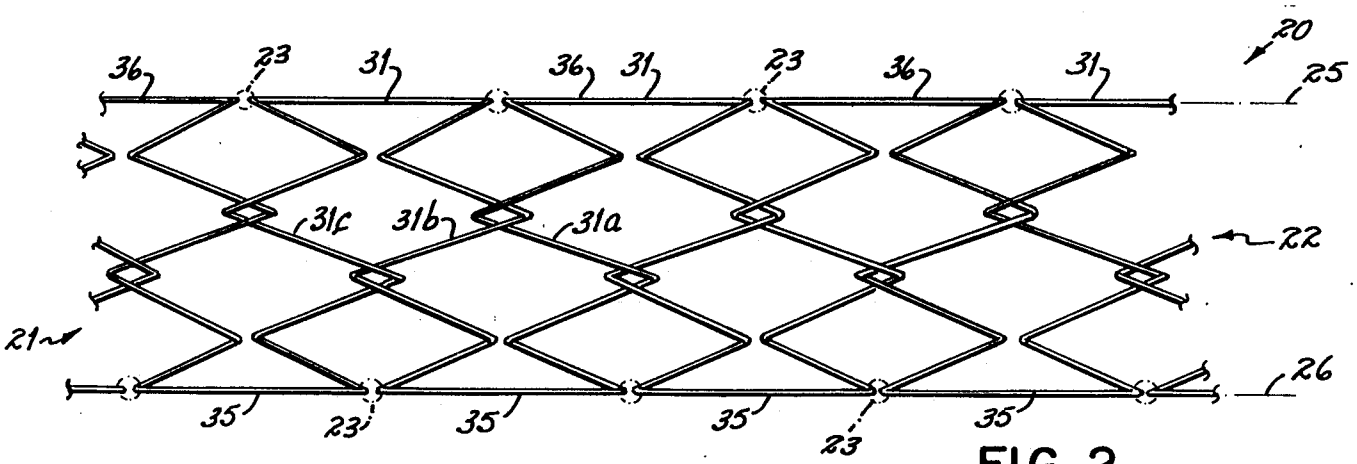
FIG. 2 is a cross-sectional view taken on line 2—2 of FIG. 1.
Figure 3:
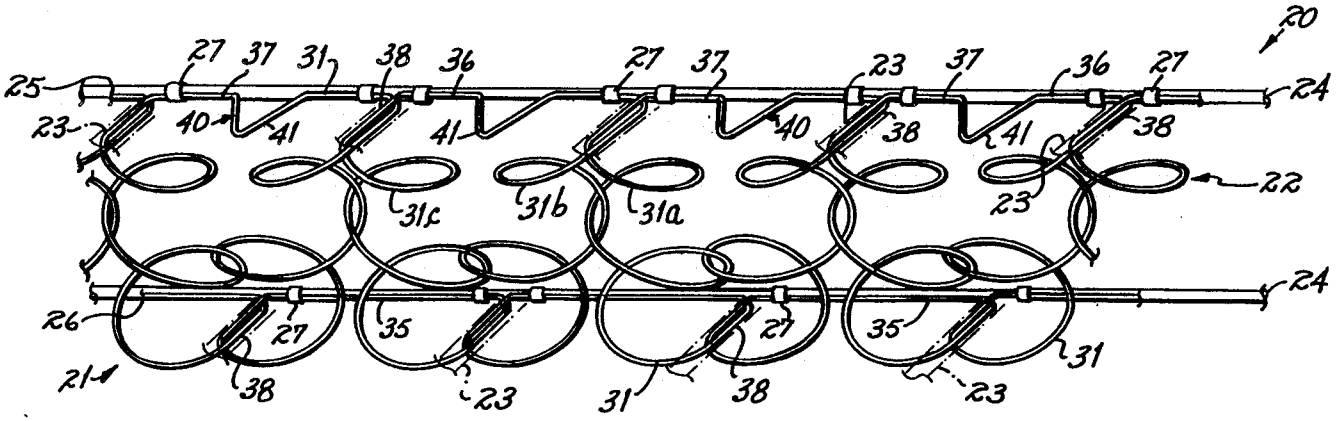
FIG. 3 is a perspective view of a portion of one band or row of springs embodied in the mattress of FIG. 1.
Figure 4:
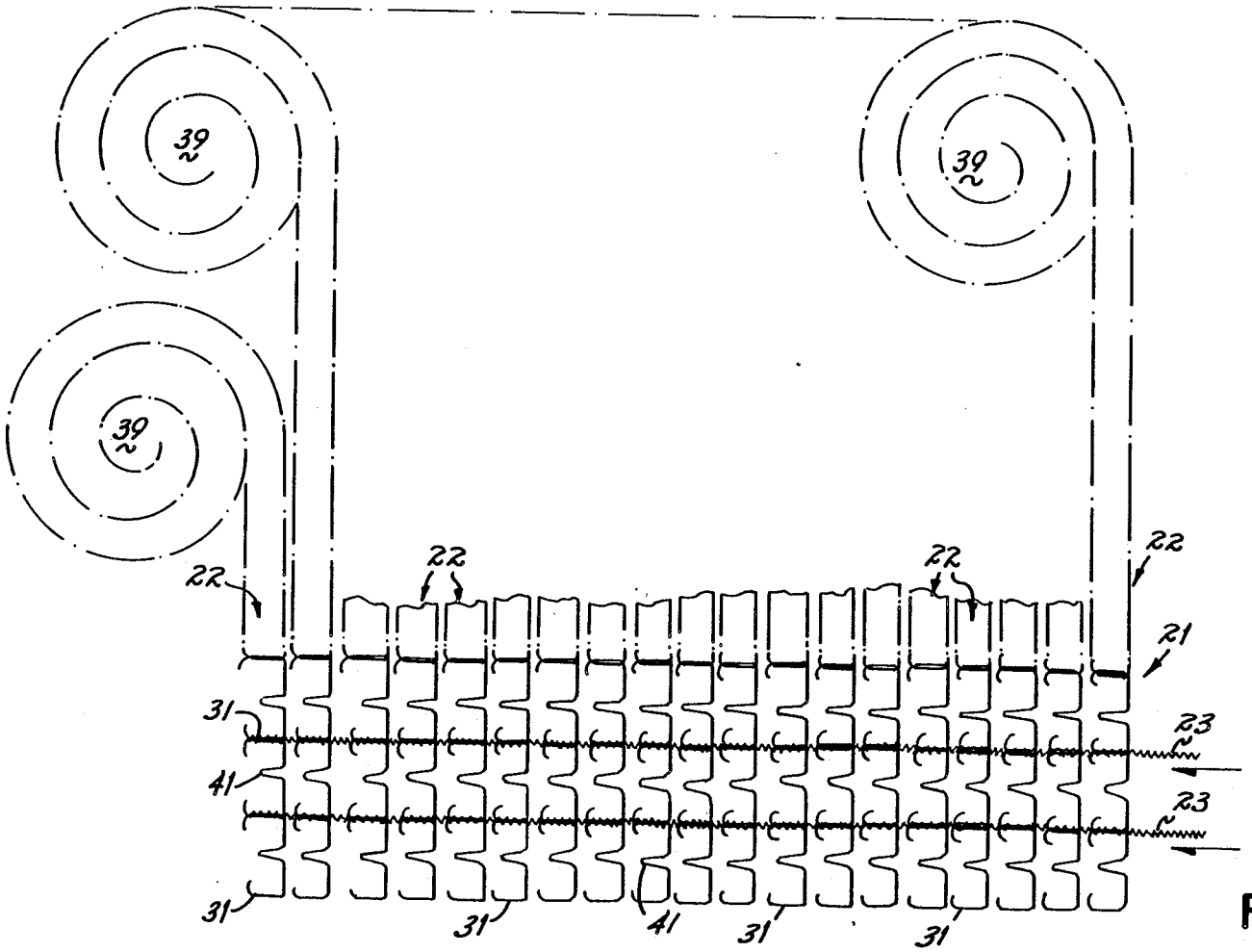
FIG. 4 is a diagrammatic view of the method of assembly of a spring interior made in accordance with the invention of this application.

With reference first to FIGS. 1–3, there is illustrated a mattress 20 embodying the invention of this application. This mattress comprises a spring interior 21 on the top and bottom surfaces of which there is a pad 19. An upholstered covering 18 encases the spring interior 21 and the pads 19.

The spring interior 21 is formed from a plurality of bands of springs 22 which extend transversely of the mattress. These bands of springs 22 are laced together by helical lacing wires 23 which extend longitudinally of the spring interior and secure the bands of springs in an assembled relation. A border wire 24 extends completely around the periphery of the spring interior in the top and bottom planes 25, 26, respectively, of the interior and is secured to the outermost edge of the spring interior in these planes by conventional sheet metal clips 27.

Each band of springs 22, a portion of one of which is illustrated in FIGS. 2 and 3, is made from a single length of spring wire shaped to form a plurality of individual coil springs 31 arranged in a row. Each coil spring 31 comprises about two and one-half turns of wire. The axis of each coil spring is not upright but is inclined slightly lengthwise of the band, each spring being inclined in a direction opposite to that in which its two adjacent springs in the row are inclined. The end turns of the coil springs 31 lie adjacent to the top and bottom faces 25, 26 of the band. Each coil spring, such as that numbered **31*b* (FIG. 3), is so coiled as to have a hand opposite to the hand of the adjacent coil springs, such as 31*a* and 31*c*, immediately before and after it in the row. Each coil spring is joined to the next adjacent coil spring by two interconnecting segments 35, 36 (FIG. 2) of the wire integral with the coil springs. One of the two interconnecting segments 35, 36 is in the top face 25 of the band 22, and the other is in the bottom face 26 thereof. For example, coil spring 31*a* (FIG. 3) is connected to coil spring 31*b* by interconnecting segment 35, which is in the bottom face of the band, and the coil spring 31*b* is connected to coil spring 31*c* by interconnecting segment 36, which is in the top face of the band. Each interconnecting segment 35, 36 comprises a bridging portion 37, which extends transversely of the row of coil springs and end portions 38 which extend in a direction normal to the transverse axis of the band 22. Those end portions 38 of the interconnecting segments 35, 36 also lie in the top and bottom faces 25, 26 of the band 22**.

Each bridging portion 37, in addition to extending transversely of the band, also has a center portion which extends longitudinally thereof to form a supporting structure 40. In the embodiment of FIGS. 1–4, the supporting structure 40 is in the form of a V-shaped indentation 41 of wire lying in the top 25 or bottom face 26 of the band 22, as the case may be, and extending to one side of the remainder of the bridging portion 37 of which it forms a part. Each V-shaped indentation 41 lies halfway between the end portions 38 of the interconnecting segment of which it forms a part, and it extends from one side face of the band toward the other side face thereof.

The adjacent coils of each band of coils 22 are interlaced o interwoven to the extent of having one intermediate turn of each coil interwoven with one intermediate turn or revolution of each adjacent coil. That is, and with reference to FIGS. 2 and 3, the coil 31*b* has one turn or revolution interlaced or interwoven with the adjacent coil 31*a* and another turn or revolution interwoven or interlaced with one turn of the adjacent coil 31*c*. Thus, each coil 31, except for the endmost coils of a band of springs 22, has two turns or revolutions interlaced with turns or revolutions of the two adjacent coils, and the endmost coil 31 has one turn or revolution interlaced with one turn or revolution of the adjacent coil of the same band 22 of coil springs.

The method of manufacturing and the apparatus for manufacturing the band of springs illustrated in FIGS. 2 and 3 is described and illustrated in British Patent No. 937,644. After the rows of coil springs are formed, each coil spring is interlaced with the next by having an intermediate turn thereof passed around an intermediate turn of the next spring. After interlacing of adjacent coils, the formed and interlaced coil springs are rolled into large rolls 39 of interconnected coil springs.

In order to form a spring interior from the rolls of interconnected coil springs, a plurality of lengths or bands of coil springs 22 are unwound from rolls 39 of coil springs and are positioned in side-by-side relationship with each band extending transversely or across the short dimension of the spring interior. Longitudinally extending preformed helical wires 23 are then attached to the adjacent bands of coil springs. The helical lacing wires 23 lie in the top and bottom faces 25, 26 of the bands and extend at right angles to the transverse axes of the bands. Each longitudinally extending helical lacing wire 23 embraces one pair of closely adjacent end portions 38 of each transversely extending band.

In accordance with the practice of one aspect of the invention of this application, one section 20*a* of the mattress 20 and spring interior 21 is posturized or increased in firmness relative to the endmost sections 20*b* and 20*c*. "Posturization" is a term of art used to describe the increasing of the firmness of one section of a mattress or spring product relative to another section. In one preferred embodiment of this invention, the posturization is the practice of increasing the firmness of the lengthwise, centermost one-third section of the mattress. This is the section which supports the greatest concentration of weight of a person reclining atop a mattress and is therefore the section most subject to sagging or drooping relative to the other endmost sections. To prevent that sagging or drooping which can cause discomfort of a person reclining atop the mattress because of the sag or unnatural curvature of the spine which occurs in the most heavily loaded, centermost section of the mattress, this section is the one which is commonly increased in firmness.

To increase the firmness of this centermost section 20*a* of the mattress and spring interior 21, the spring interior 21, the centermost five bands of coil springs 22*a* which extend transversely of the spring interior contain coil springs 31 which are of increased firmness relative to the coil springs of all of the other bands of coil springs. In the preferred embodiment of this invention, this increased firmness is imparted by having the centermost bands 22*a* of coil springs made from heavier gauge wire than that from which the other endmost sections 20*b*, 20*c* are made. For example, and in one preferred embodiment, the centermost section 20*a* was made from bands of 14 1/2 gauge wire approximately 0.076 inches in diameter, and the endmost sections 20*b* and 20*c* were made from 15 gauge wire approximately 0.072 inches in diameter. Because the individual bands of springs are uncoiled from rolls of interlaced coil springs, as opposed to being fed directly into the assembly machine from a coil forming machine, the bands of coil springs of the spring interior may easily be varied in gauge or wire diameter. Thereby, the firmness of differing longitudinal portions of the spring interior may be easily and inexpensively varied without substantially increasing the cost of the spring interior.

While in the preferred embodiment, the spring interior 21 has been described as containing five transverse rows of increased firmness coil springs in the longitudinal center portion of the spring interior, it could, of course, contain greater or lesser numbers of rows of differing firmness coils, depending upon the length of the section to be increased in firmness. Alternatively, the bands of increased firmness coils could be located at the ends of the spring interior, as illustrated in FIG. 1, so as to impart increased edge firmness at the ends of the spring interior. Alternatively, rather than having the wires from which the center or end portions of the spring interior differ in gauge or diameter, the wires could all be of the same diameter, but differ in tensile strength or in relaxed height of the individual coils of the bands of coil springs so as to impart differing coil firmness to the bands of coil springs when compressed and assembled in the different longitudinal sections of the spring interior. If bands of springs of differing height of the individual coils in the relaxed state are used to increase the firmness of the bands, rather than differing gauge wire, then the spring interior may be contoured, when upholstered, so as to impart higher or lower ends than centers or vice versa, etc.

While I have described only a relatively few preferred embodiments of my invention, persons skilled in the art to which it applies will appreciate changes and modifications which may be made without departing from the spirit of my invention. Therefore, I do not intend to be limited except by the scope of the following appended claims:

I claim:

1. A bedding mattress comprising a spring interior having a relatively long longitudinal dimension and a relatively shorter transverse dimension, said spring interior having a plurality of parallel bands of springs, each band of springs comprising a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before and after it in the row and being interlaced with the adjacent coil springs of the same row, each coil spring being joined to said adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion, the bands being disposed side by side so that their top faces lie in a top main face of the spring interior and their bottom faces lie in a bottom main face of the spring interior, the bands being interconnected by helical wires lying in the top and bottom faces of the bands and extending across the bands, each helical wire embracing portions of wires of the bands that extend from the ends of said bridging portions thereof, there being, in each face of the spring interior, two springs in the interval between each helical wire and the next, padding overlying at least one of said main faces of said spring interior, an upholstered covering material encasing said spring interior and said padding, and the spring interior being characterized by said bands of springs extending transversely of the spring interior and said helical wires extending longitudinally of the spring interior, at least one longitudinal section of the spring interior having coil springs which are all of differing physical characteristics relative to the coil springs of the other longitudinal sections.

2. A spring interior having a relatively long longitudinal dimension and a relatively shorter transverse dimension, said spring interior having a plurality of parallel bands of springs, each band of springs comprising a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a hand opposite t the hand of the adjacent coil springs immediately before and after it in the row and being interlaced with the adjacent coil springs of the same row, each coil spring being joined to said adjacent coil springs by interconnecting segments integral with the coil springs, one of said interconnecting segments being located substantially in the top face of the band and the other of said interconnecting segments being located substantially in the bottom face of the band, and each interconnecting segment including a bridging portion, the bands being disposed side by side so that their top faces lie in a top main face of the spring interior and their bottom faces lie in a bottom main face of the spring interior, the bands being interconnected by helical wires lying in the top and bottom faces of the bands and extending across the bands, each helical wire embracing portions of wires of the bands that extend from the ends of said bridging portions thereof, there being, in each face of the spring interior, two springs in the interval between each helical wire and the next, and the spring interior being characterized by said bands of springs extending transversely of the spring interior and said helical wires extending longitudinally of the spring interior, at least one longitudinal section of the spring interior having coil springs which are all of differing physical characteristics relative to the coil springs of the other longitudinal sections.

3. The spring interior of claim 2 characterized in that the wire of said bands of coil springs in said at least one longitudinal section of said spring interior is of greater resistance to deflection than the wire of said bands of coil springs in said other longitudinal sections of said spring interior.

4. A spring interior according to claim 2 characterized in that the wire of said bands of coil springs in said at least one longitudinal section of said spring interior is of larger diameter than the wire of said bands of coil springs in said other longitudinal sections of said spring interior.

5. A spring interior according to claim 2 characterized in that the wire of said bands of coil springs in said at least one longitudinal section of said spring interior is of greater tensile strength than the wire of said bands of coil springs in said other longitudinal sections of said spring interior.

6. A spring interior according to claim 2 characterized in that the coil springs of said bands of coil springs in said at least one longitudinal section of said spring interior are of differing height in the relaxed state of the coil springs than the coil springs of the bands of coil springs in said other longitudinal sections of said spring interior.

* * * * *

UNITED STATES PATENT AND TRADEMARK OFFICE

CERTIFICATE OF CORRECTION

PATENT NO. : 4,972,536

DATED : November 27, 1990

INVENTOR(S) : Terence A. Scott

It is certified that error appears in the above-identified patent and that said Letters Patent is hereby corrected as shown below:

Column 3, line 47, change "t" to --to--.

Column 4, line 67, change "o" to --or--.

Column 7, line 28, change "t" to --to--.

Signed and Sealed this

Twenty-fifth Day of August, 1992

*Attest:*

DOUGLAS B. COMER

*Attesting Officer*

*Acting Commissioner of Patents and Trademarks*